United States Patent [19]

Fleckenstein

[11] 4,368,597

[45] Jan. 18, 1983

[54] MINIATURE BELT GRINDER

[75] Inventor: Elwin H. Fleckenstein, Alden, N.Y.

[73] Assignee: Dynabrade, Inc., Tonawanda, N.Y.

[21] Appl. No.: 181,968

[22] Filed: Aug. 28, 1980

[51] Int. Cl.[3] ..... B24B 23/06

[52] U.S. Cl. ..... 51/170 EB; 51/148; 51/268

[58] Field of Search ..... 51/170 EB, 148, 170 R, 51/268, 269; 24/213 R, 219, 220, 107

[56] References Cited

U.S. PATENT DOCUMENTS

| | | | |
|---|---|---|---|
| 192,267 | 6/1877 | Kuder | 24/213 R |
| 756,090 | 3/1904 | Yankie | 24/213 R |
| 1,744,766 | 1/1930 | Hood | 51/268 |
| 1,841,787 | 1/1932 | Carter | 51/170 EB |

FOREIGN PATENT DOCUMENTS

| | | | |
|---|---|---|---|
| 823199 | 11/1959 | United Kingdom | 51/170 EB |

OTHER PUBLICATIONS

Dynabrade Pamphlet, Dynabrade Inc., Model 76, DBL-2177, May 1977.

*Primary Examiner*—Roscoe V. Parker
*Attorney, Agent, or Firm*—Bean, Kauffman & Bean

[57] ABSTRACT

A portable belt grinder having a casing, a drive pulley supported in the casing, a contact pulley mounted on an arm extending from the casing, an endless belt trained about the pulleys and a belt tensioning assembly having a roller eccentrically mounted on a manually rotatable rod, a camming surfaced plunger coacting with the roller and a spring interposed between the arm and the plunger. A cover is pivotally mounted on the casing having an aperture which coacts with a latching button rotatably fixed to the casing and having a vertical axis slightly spaced from the vertical axis of the aperture.

9 Claims, 5 Drawing Figures

MINIATURE BELT GRINDER

SUMMARY OF THE INVENTION

The present invention relates to portable belt grinders for use within small cavities or restricted openings in sheet metal, castings, forgings and the like for deburring and finishing operations wherein an endless belt having an outer abrasive surface is extended between a drive pulley and contact pulley and, more particularly, to an improved arrangement for adjusting the tension of the belt between the two pulleys.

The present invention also relates to an improved safety cover latching arrangement for collective use in combination with such grinders, and for use, generally, with other types of grinders as well. As a safety precaution, the casing opening of the grinder adjacent the hand held motor portion or other operational components thereof contains a protective cover to protect the operator from flying debris and the like from the abrasive belt as portions thereof move from the contact pulley adjacent the work to the drive pulley within the casing. It is important that the means for latching the cover to the housing have a relatively long useful life in view of the frequent openings and closings of the cover for changing the belt or the like. It is, therefore, a feature of the present invention to provide an improved latching structure which will permit frequent openings and closings of the cover without the necessity of replacing the same because of wear.

Essentially, the latching structure of the present invention comprises a button fabricated of a suitable resilient material, removably secured to the casing of the hand grinder and cooperates with an opening or aperture in the cover for securing the cover in its closed position by snap action of the aperture about the resilient button. According to the present invention, the button is substantially symmetrical about the vertical axis thereof and has a peripherally enlarged lip, only a portion of which engages the aperture in the cover at any one time. The axis of the aperture is spaced from the axis of the button such that the peripheral lip thereof is eccentric to the aperture. In this manner, as the portion of the peripheral surface of the button wears due to frequent openings and closings of the cover, a new, unworn portion thereof may be brought into contact with the aperture by simply rotating the button about its axis. Further, the resilient peripheral lip may be enlarged radially to extend the useful life thereof and to also accommodate enlargements in the cover opening due to wear.

With belt grinders of the type indicated above it is important to have an effective, quick and efficient way of replacing the belt and of adjusting the tension thereof for proper operation. To this end, it is an additional feature of the present invention to provide, in combination with a belt driven portable grinder, means for efficient, simple and rapid adjustment of the belt tension, either for belt removal or for optimum operating conditions.

More specifically, the combination of the present invention comprises in a grinder having a casing, a drive pulley rotationally supported within the casing, a contact pulley spaced from the drive pulley and supported for rotation by an arm assembly slidably extending from the casing, a belt trained about the pulleys and an improved belt tensioning mechanism including spring means for normally biasing the arm to a position of maximum extension from the casing and manually actuated means for reducing the biasing force of the spring means whereby the arm can be easily retracted from its position of maximum extension, wherein both the spring means and manually actuated means are supported by a common post upstanding within the casing.

According to a second aspect of the present invention there is provided in the combination of a portable grinder having a casing, an opening in the casing, a cover, for closing the casing opening, pivotally supported by the casing, an aperture in the cover, the improvement comprising; substantially symmetrical latching means removably supported by the casing and rotatable about an axis that is parallel to and spaced from the axis of the cover opening whereby only a portion of the periphery thereof contacts the opening as the cover is closed.

It is to be understood that the latching means may be a component of the grinder in combination with the belt tensioning mechanism or, alternatively, a component of other types of grinders having covers enclosing portions of the interiors thereof.

BRIEF DESCRIPTION OF THE DRAWINGS

For a fuller understanding of the present invention, reference should be made to the following detailed description thereof taken in conjunction with the accompanying drawings, wherein.

DETAILED DESCRIPTION OF THE PREFERRED EMBODIMENT

Figures 1, 2, 3, 4, 5:
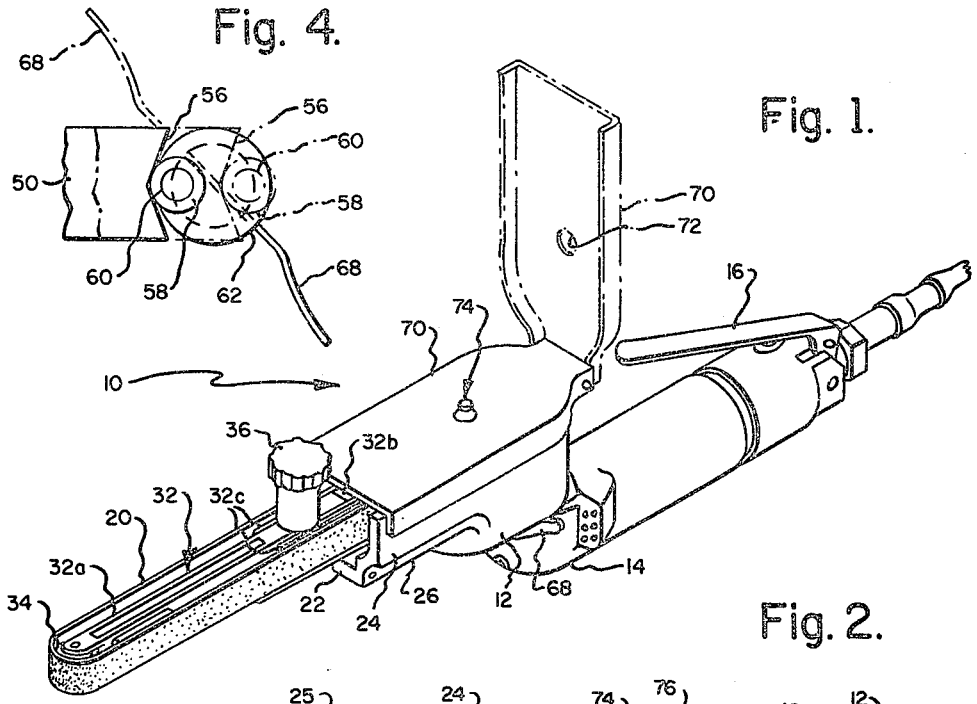
FIG. 1 is a pictorial view of the belt grinder according to the present invention.
FIG. 2 is a top plan fragmentary view of the device shown in FIG. 1 with the cover thereof broken away to expose the elements therebelow.
FIG. 3 is a fragmentary elevational view of the device of FIG. 2 with portions thereof depicted in broken-away section.
FIG. 4 is a top plan detail view of the belt tensioning cam according to the present invention and taken substantially along line 4—4 of FIG. 3.
FIG. 5 is a top plan detail view of the latching means according to the present invention taken substantially along line 5—5 of FIG. 3.

Referring now to the drawings in detail, a tool modified in accordance with the present invention is generally depicted at 10 and is shown as having a casing 12 and an associated power source, such as a pneumatically operated motor 14, which may be gripped by the hand of an operator for manipulation of the tool. Motor 14 may have any suitable shutoff or speed control, such as that afforded by pivotally supported lever 16, which is adapted to be squeezed by the hand of an operator during use. However, it will be understood that the invention to be described hereinbelow is not limited to the use of a pneumatically operated motor or the specifically illustrated design of casing 12. Thus, as by way of example, the operating motor may be electric and housed within a casing having a pistol-like hand grip.

A drive pulley 18 is located in casing 12 and driven by motor 14 for rotation about a substantially vertical axis, as viewed in FIG. 3; pulley 18 functions to frictionally drive a flexible, endless belt 20 having an outer abrasive surface for contacting a workpiece.

Casing 12 has a forward projecting, generally channel-shaped open end 22 bounded by a pair of sidewalls 24, defining an upper opening 25, and a bottom platform or wall 26 containing a centrally located slot 28 extending from end 22 to a point short of a central post 30 vertically projecting from platform 26, as viewed in FIG. 3. A compound arm assembly, generally depicted at 32, slidingly projects outwardly from housing 12 and supports a contact pulley 34 for rotation thereof about an axis substantially parallel to the rotational axis of drive pulley 18. The endless belt 20 is thus supported between pulleys 18 and 34 for translational movement thereabout in a well known manner.

The arm assembly 32 is formed of two sections; a longitudinally extending forward section 32*a* supporting the pulley 34 and a rearward section 32*b* fitted into the casing and projecting slightly therefrom. Section 32*a* is fitted within bifurcated ends 32*c* of section 32*b* and adjustably secured thereto by means of a fastening device 36 spanning the surfaces of the two sections. A spring 38 is located between sections 32*a* and a ledge 32*d* of section 32*b* for normally biasing them away from each other. This arrangement is generally similar to that disclosed in prior U.S. Pat. No. 3,823,513 for the purpose of adjusting the effective relative tilting of the contact pulley supporting section for controlling tracking of non-uniformly worn belts.

Turning now to a description of the belt tensioning mechanism of the present invention and with specific reference to FIGS. 3 and 4, it can be seen that rearward arm section 32*b* has a guide member 40 depending therefrom for coaction with slot 28 for limiting translational movement of the arm between the limits imposed by the casing end of the slot and a pin 42 located at the other end thereof; and for constraining rotational movement of the arm. Between these limits the arm can slide about a generally tubular support or guide rod 44 fitted at one end into a coaxial blind bore 46 in the arm section 32*b;* the other end of which being fixedly secured within casing post 30 by fastening means 48. A tension plunger 50 is slidably received in bore 46 and is of generally cylindrical construction having one end in engagement with a compression spring 52 that is interposed between this end and a spring plug 54 in abutting contact with the bore 46. The other end of plunger 50 terminates in a substantially V-shaped transverse camming surface 56. Coacting with camming surface in contacting relation therewith is a roller 58, supported by a pin 60 projecting eccentrically from the central axis of a rod 62 which passes through, and is supported for rotation by, a bushing 64 that is fixedly secured within a throughbore 66 in casing 12 adjacent the drive pulley 18. A tension lever 68 is suitably affixed to, and perpendicularly disposed in relation to, an end of rod 62 that projects from the bottom surface of the casing, to facilitate rotation of the rod by the hand of an operator. A resilient material dust seal 69 or the like may surround the outer surface of bore 46 and support rod 44.

The operation of the belt tensioning mechanism should be readily apparent from the foregoing description thereof. More specifically, in the solid line position of the roller 58 it can be seen that the plunger 50 exerts maximum force on the spring 52 which, through spring plug 54, causes maximum extension of arm assembly 32 and contact pulley 34 for applying maximum tension to the belt 20. As the roller 58 is moved to the dotted line position in FIG. 3 by counterclockwise rotation of actuating lever 68 and rod 62, the roller rides out of contact with the longitudinal center of the V-shaped depression of surface 56 to thereby permit the same to move closer to the casing 12 under the biasing pressure of spring 52, which causes the tension on belt 20 to be relieved by reducing the bias of the spring. After substantially 180 degrees of movement of the roller 58, it again assumes a rest position in the center of V-shaped surface 56; this being the position of minimum bias on spring 52 and, accordingly, the minimum belt tension position whereby the arm can be easily retracted towards the casing and the belt 20 can be quickly and easily removed and replaced.

Referring now to the second aspect of the present invention wherein an improved latching means is provided for the miniature tool grinder and referring, more particularly, to FIGS. 1, 3 and 5 the casing 12 is provided with a pivotally mounted cover or safety shield 70 which, in the closed position thereof, rests on side walls 24 of the casing and closes upper opening 25, to prevent flying debris, grit or the like from injuring the operator. Cover 70 has an aperture 72 therein which in its closed position coacts with a latch means 74 removably secured to the casing post 30 adjacent the fastening means 48 thereon. Latch means 70 may conveniently take the form of a resilient material button having an enlarged diameter central section 76 defining an annular lip or the like which is symmetrical about a vertical axis thereof, as viewed in FIG. 3. As depicted in FIG. 5, it is important to note that this axis of the button is parallel to, but slightly spaced from, the central axis of aperture 72 which thereby provides an eccentric relationship between the aperture and the lip. Because of this relationship, only a portion of the lip contacts the cover opening as the cover is snapped thereover into its closed position. As illustrated in FIG. 3 the button is secured to the post 30 by means of a screw 78 and is rotatable about the shank portion thereof. Thus, it should be readily apparent that as the portion of the lip which contacts the cover opening wears to the point where it can no longer function to securely latch the cover in place, it is a relatively simple matter for the operator to rotate the lip about the shank of the screw to provide a new unworn peripheral surface thereof for contacting the aperture of opening. Further, since the button is fabricated of a resilient material the lip can be enlarged in diameter by tightening screw 78 to thereby cause a bulging out of the lip. In either case, the life of the button is significantly extended. Moreover, in the event that opening 72 enlarges due to wear, the enlarged lip can still coact therewith. The cover 72 may be fabricated of any suitable material such as metal or plastic that is less resilient than the button.

Although a preferred embodiment of the present invention has been disclosed and described changes will obviously occur to those skilled in the art. For example, the belt tensioning mechanism and the latching means could obviously be applied to a grinder wherein a single pulley supporting arm is employed instead of the specific compound arm described. Further, the latching means can be applied to other types of grinders. It is therefore intended that the present invention is to be limited only by the scope of the appended claims.

What is claimed is:

1. A portable belt grinder comprising in combination:

a casing having an open front end and an open top;

a drive pulley;

means for mounting said drive pulley in said casing effecting driven rotation thereof;

a contact pulley;

means for mounting said contact pulley exteriorly of said casing and for rotation about an axis essentially parallel to the axis of rotation of said drive pulley, said drive pulley and said contact pulley being adapted to support an abrasive belt trained thereabout, said means for mounting said contact pulley includes a post upstanding within said casing lengthwise intermediate said drive and contact pulleys and transversely intermediate runs of said belt when trained about said drive and contact pulleys, an arm extending through said front end of said casing having an outer end for mounting said contact pulley and an inner end, a guide means cooperating with said inner end of said arm for supporting said arm for reciprocating movement to vary the distance between said drive and contact pulleys, spring means for biasing said arm for reciprocating movement increasing the distance between said drive and contact pulleys for tightening said belt, means carried by said post for selectively varying said bias of said spring means to provide for loosening of said belt;

a cover hingedly mounted on said casing adjacent a rear portion thereof for closing said open top, an aperture in said cover, latch means for releasably locking said cover in a position closing said open top, said latch means including a resiliently deformable member arranged to upstand from said post for receipt within said aperture.

2. A portable belt grinder according to claim 1, wherein said guide means is a sleeve mounted on said post to extend forwardly within said casing, said sleeve supporting said arm for both rotational and axially sliding movements relative thereto, and means carried on one of said arm and casing for constraining said arm from rotation relative to said sleeve while permitting reciprocating movements lengthwise thereof.

3. A portable belt grinder according to claim 2, wherein the last said means defines stops limiting the degree of said reciprocating movement.

4. A portable belt grinder according to claim 1, wherein said resiliently deformable member comprises a symmetrical button having an enlarged diameter central lip, the axis of said button being spaced from the central axis of said cover aperture, whereby only a peripheral portion thereof coacts with said aperture as the cover is brought into closed position.

5. A portable belt grinder according to claim 2, wherein said means carried by said post comprises; a sliding plunger having one end in contact with said spring means and the other end having a camming surface, a rod supported for rotation in said casing, a roller eccentrically mounted on one end of said rod for coaction with said camming surface and a manually actuable lever affixed to the other end of said rod to effect rotation thereof.

6. In a portable belt grinder having a casing provided with an open front end, a drive pulley rotatably supported within the casing, a contact pulley arranged exteriorly of said casing and supported for rotation by an outer end of an arm extending from the casing through said open front end, an endless belt trained about the pulleys and a belt tensioning mechanism, the improvement wherein said mechanism comprises in combination:

a post arranged to upstand within said casing from a bottom wall thereof and positioned transversely intermediate runs of said belt passing between said drive and contact pulleys; a generally tubular support having one end fixed to said post and extending towards said open front end; a blind bore formed in an opposite end of said arm for slidably receiving said tubular support; means carried on one of said arm and said bottom wall of said casing for constraining said arm from rotation relative to said tubular support while permitting reciprocating movements of said opposite end of said arm lengthwise thereof; a plunger slidably supported within said tubular support; a spring positioned within said blind bore with its opposite ends arranged for engagement with said arm and one end of said plunger, said plunger having an opposite end provided with a camming surface and arranged within said post; a rod rotatably supported within said post to extend transversely of said tubular support, said rod having one end projecting through said bottom wall of said casing and an opposite end arranged within said post and carrying means mounted eccentrically of the axis of rotation of said rod, the last said means engaging with said camming surface for effecting movement of said plunger within said tubular support for varying the bias of said spring incident to rotation of said rod; and a lever fixed to said one end of said rod for effecting rotations thereof.

7. The improvement according to claim 6, wherein said means for constraining said arm from rotation includes a through slot formed in said bottom wall of said casing and having an open end arranged adjacent said open front end of said casing and a closed end arranged adjacent said post, a pin closing said open end of said slot and a guide member depending from said opposite end of said arm and slidably received within said slot for limiting sliding movements of said arm between limits imposed by said closed end of said slot and said pin; and said mechanism additionally includes a dust seal disposed in a surrounding relationship to said opposite end of said arm and said tubular support.

8. A portable belt grinder comprising in combination:

a casing having an open front end and an open top;

a drive pulley;

means for mounting said drive pulley in said casing and effecting driven rotation thereof;

a contact pulley;

means for mounting said contact pulley exteriorly of said casing and for rotation about an axis essentially parallel to the axis of rotation of said drive pulley, said drive pulley and said contact pulley being adapted to support an abrasive belt trained thereabout, said means for mounting said contact pulley includes a post upstanding within said casing lengthwise intermediate said drive and contact pulleys and transversely intermediate runs of said belt when trained about said drive and contact pulleys, an arm extending through said front end of said casing having an outer end for mounting said contact pulley and an inner end, a guide means cooperating with said inner end of said arm for supporting said arm for reciprocating movement to vary the distance between said drive and contact pulleys, said guide means includes a tubular support fixed to said post and extending towards said front end of said casing, a blind bore formed in said inner end of said arm for slidably receiving said tubular support, a guide member depending from said inner end of said arm, a through slot formed in a bottom wall of said casing from which said post upstands and having a closed end and an open end, and means for closing said open end of said slot, said guide member is slidably supported within said slot and cooperates therewith to constrain rotational movements of said arm relative to said tubular support and cooperates with said closed end of said slot and said means for closing said open end thereof for limiting the extent of reciprocating movement of said arm, spring means for biasing said arm for reciprocating movement increasing the distance between said drive and contact pulleys for tightening said belt, means carried by said post for selectively varying said bias of said spring means to provide for loosening of said belt;

a cover for closing said open top; and latch means carried by said post for retaining said cover in an open top closed condition.

9. A grinder according to claim 8, wherein there is additionally provided a plunger slidably supported within said tubular support, said spring is positioned within said blind bore with its opposite ends arranged to engage with said arm and one end of said plunger, said plunger having an opposite end provided with a camming surface positioned within said post; and said means carried by said post includes a rod rotatably supported within said post, said rod having one end thereof projecting exteriorly of said casing through said bottom wall and an opposite end carrying means mounted eccentrically of the axis of rotation of said rod and arranged for engagement with said camming surface for effecting movement of said plunger within said tubular support for varying the bias of said spring, and said one end of said rod carries a lever manually manipulatable to effect rotation of said rod.

* * * * *